United States Patent [19]

Wiser

[11] 4,116,512

[45] * Sep. 26, 1978

[54] DRAWER LATCHING DEVICE

[76] Inventor: John A. Wiser, P.O. Box 192, Liberty, Tex. 77575

[ * ] Notice: The portion of the term of this patent subsequent to Jun. 7, 1994, has been disclaimed.

[21] Appl. No.: 739,425

[22] Filed: Nov. 8, 1976

Related U.S. Application Data

[62] Division of Ser. No. 589,417, Jun. 23, 1975, Pat. No. 4,027,934.

[51] Int. Cl.[2] ..... A47B 58/00; E05C 17/56

[52] U.S. Cl. ..... 312/330 R; 312/333; 292/251.5; 248/206 A

[58] Field of Search ..... 312/330, 333; 292/251.5; 248/206 A; 211/DIG. 1

[56] References Cited

U.S. PATENT DOCUMENTS

| | | | |
|---|---|---|---|
| 950,813 | 3/1910 | Bodenstein | 312/333 |
| 1,171,185 | 2/1916 | Fox | 312/333 |
| 2,609,221 | 9/1952 | Schultz | 292/251.5 |
| 2,747,501 | 5/1956 | Latimer | 248/206 A |
| 2,954,253 | 9/1960 | Teetor | 292/251.5 |
| 3,403,933 | 10/1968 | Rossow | 292/251.5 |
| 3,539,214 | 11/1970 | Fisher | 292/251.5 |

*Primary Examiner*—Kenneth Downey
*Assistant Examiner*—Victor N. Sakran
*Attorney, Agent, or Firm*—Kenneth H. Johnson

[57] ABSTRACT

A valet rack comprising in combination a plurality of drawers in a body, said drawers having a magnetic means located at the back thereof to cooperate with a magnetic means in the body to provide a positive locking of the drawer in the closed position in the body, and a plurality of hangers located below and in operational relation with the body, being slidably mounted thereto and comprising a back plate, at least one holding member, e.g., a rod extending from the back plate and a biasing means for urging the hangers together such that the rod of the hanger is adjacent to the back plate of the next hanger.

1 Claim, 6 Drawing Figures

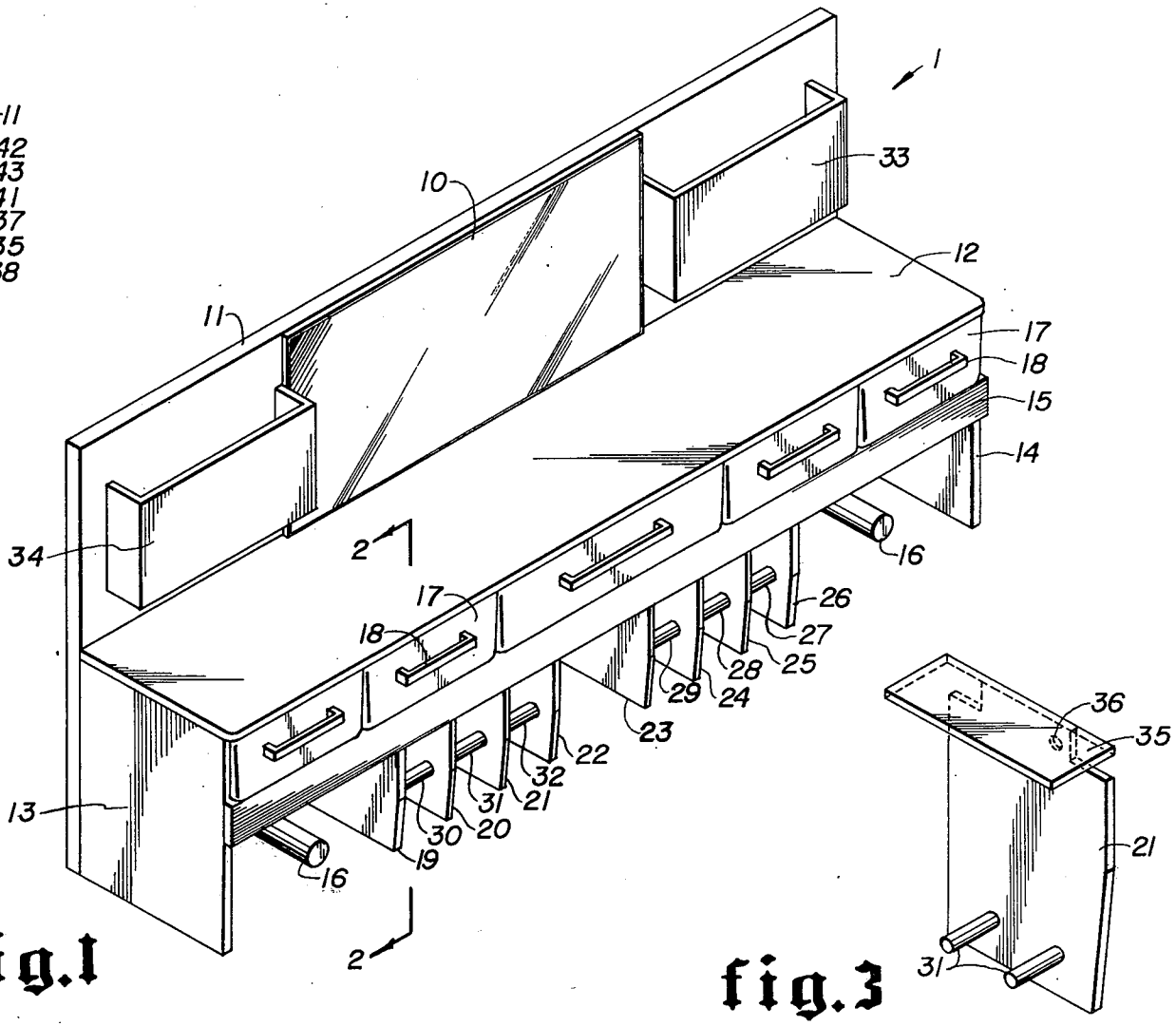
fig.1
fig.3
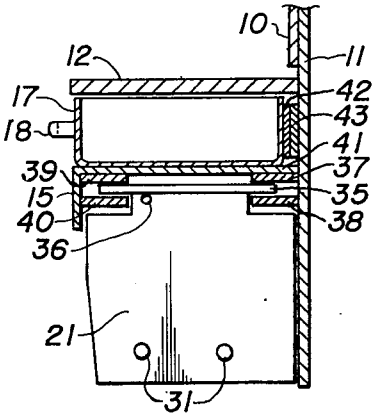
fig.2

DRAWER LATCHING DEVICE

This is a division, of application Ser. No. 589,417 filed June 23, 1975, now U.S. Pat. No. 4,027,934.

The present invention relates to a rack, and more particularly to a valet rack for storing ties and the like and other items of apparrel or jewelry. The invention also relates to subcombinations relating to the hangers and to the means of securing drawers in place.

The art is replete with racks which are designed to serve various purposes, for example U.S. Pat. No. 3,380,594 to MacCluney discloses a rack for pre-tied neckties. This rack comprises a baseboard with rods having discs extending therefrom, projecting out from the baseboard. The rods are spaced apart and aligned so that a pre-tied tie may be placed with one side on each of two of the rods between two of the discs. This can be a singular arrangement or can be arranged in groups.

Another rack designed to display automobile fan belts is disclosed in U.S. Pat. No. 2,246,081 to Van Nattan, in that arrangement a number of downward projecting hooks are movably on a horizontal bar. The hangers are longitudinally movable as well as pivotally movable about the bar. Each hanger is arranged adjacent to the next hanger.

A similar arrangement to that of Van Nattan is shown in U.S. Pat. No. 3,568,852 to Howard which shows a series of hangers slidably mounted on a horizontal bar.

Another type of hanger frequently found in the prior art is shown in U.S. Pat. No. 2,051,408 issued to Karst comprising a bracket having a plate for mounting onto a surface and two substantially parallel rods extending perpendicular from the base plate. Although all of these inventions are indeed meritorious, there are certain defieiencies which the present invention sought to overcome. For example, the Van Nattan device although potentially movable along the rod, is not designed for that type of operation and is designed merely to have each hanger rotate about the rod and allow access to the hook portion when the hanger is rotated out of alignment with the other hangers. This does have restrictions on the amount of space available for the insertion of items onto the hanger. The MacCluney device is quite similar to the individual bracket arrangements as shown by Karst. For limited applications these arrangements are quite adequate, however it should be appreciated in order to hold a substantial amount of items, that large wall surfaces will be required, and with large number of rods projecting outward from the wall. The Howard sliding carrier means provides for no arrangement other than random placement of the hangers on the rod, and is designed for rather large bulky carrying operations, for example in the textile industry for carrying material samples or the like.

In the present invention a unique closure method has been developed for maintaining the drawer compartments of the valet rack in a closed position, and thereby secured in such closed position. Although the prior art may have many unique methods of fastening a drawer in the closed position, not many of these are relevant to the present invention, however, U.S. Pat. No. 3,048,462 to Fisher discloses a unique method for sealing a drawer opening in a refrigerated cabinet when the drawer is removed therefrom. This method of sealing consist of a metal plate, magnetically larger than the opening through which drawer passes and magnets being mounted internally of the opening so that as the drawer is withdrawn through the opening, the larger metal plate is grasped by the magnets about the opening and broken free from the magnets holding it on the back of the drawer, thereby providing a seal for the opening. Thus, although the opening may be sealed, this arrangement does not relate to securing the drawer.

The desirability of some manner of securing a drawer in the closed position, relates to drawers which might be mounted in movable areas such as mobile homes, ships, barges, mobile workshops, and the like. It would be desirable to have drawers which would not easily come open but which could be opened with only a minimal exertion of manual force, and which do not involve complicated and expensive latching devices, which can add both to the initial cost and result in maintenance upkeep.

It is an advantage of the present invention that there are no forward projecting rods, which may present a hazard yet the hanging means are provided which function in the same fashion as many as the prior art devices. Furthermore, because of the particular arrangement of the present apparatus a number of items may be stored on each hanger and yet the hanger may occupy only a very small space out from whatever surface it is mounted onto. Another feature of the present invention is that the hangers are always maintained in a closed position when not being used for placing or removing items thereon. A particular feature of the present invention is that the hangers may be separated when access thereto is sought so that a substantial amount of space is available for removing or placing items thereon. It is a particular feature of the present invention that it may be incorporated with other novel elements to form a unitary device suitable for use as a valet rack for men and women. It is a particular feature of the present invention that novel means for securing storage compartments in a closed position are disclosed. These and other features and advantages of the present invention will become apparent in the following detailed description of the invention in regard to the drawings.

SUMMARY OF THE INVENTION

Briefly stated the present invention is a valet rack or hanger comprising a body having openings therein and drawers movably located in said openings and a plurality of hanger elements positioned therein and in operable relationship with said body, said drawers having a metal member fixedly attached at the back thereof, adjacent to a portion of said body, said body having a metal member affixed thereon to contact the metal member on said drawer when said drawer is in the closed position, at least one of said metal members being magnatized, said hanger elements being horizontally slidably mounted, and comprising a back plate, at least one holding member projecting from said plate and mean biasing said hangers together.

The body of the valet hanger, is conventional and comprises a front, two sides, and a back. The back may be made of metal, or may have a metal element attached thereto. The metal may be in the form of the newly developed elastomeric compositions containing finely divided metal particles. A metal element or member is fixedly attached to the drawer, if not a portion thereof. The metal member on the drawer is external of the drawer such that the metal will abut a portion of the body. This may be the back portion of the body or it may be an especially provided metal member therein. On the portion of the body against which the back of the drawer abuts in the closed position, there will also be a metal member which may have the same characteristics as the metal member of the drawer. The principle limitation is of course that metal be magnetizable, thereby excluding a metal such as aluminum or copper. It has been found that having merely a magnet mounted at the back of the body and a metal surface attached to the back of the drawer is an excellent arrangement, which provides the requisite holding power, but does not create such a bond between the two surfaces so that any great physical force is necessary to pull the drawer into the open position. This arrangement is an excellent means for any moving structure which has drawers. It is simple, inexpensive and requires no maintenance, yet gives a positive locking action when the drawer is fully seated into the body. A side benefit when this arrangement is used in a home garage or other location is that the magnetic attraction can be of such a nature as to discourage small children from opening the drawer and investigating the contents, yet not inconvenient to the adults who use the device. The hanger is mounted to the body below the drawers. Alternative means of mounting the hangers will be shown and discussed hereafter. One mounting means is provided by slots along a portion of the body wherein elements of the hanger slide in the slots. The alternative method of mounting is a rod attached across the body, or a portion thereof, onto which the hangers are mounted by an opening through a portion of the hanger. These two means of mounting are equivalent in their function, and the requirements of manufacturing simplicity would dictate which one or the other is more desirable. The hanger itself is comprised of a mounting member, a back plate or hanger element, and at least one means projecting perpendicular from the back plate on which to hang items. There may be more than one of these projections onto which a tie or other item can be placed. A plurality of two or more of the hangers are slidably mounted on the body, such that for each adjacent hanger, the projection of one is adjacent to the back portion of the next adjacent hanger. A means is provided to bias the hangers together so that the projections are in proximate relationship to the immediate adjacent hanger back plate. In some embodiments, the projecting members may actually contact the back plate. Two methods of biasing are shown. Both comprise only a single biasing, means comprising either a compression or tension spring or pair of springs operating in parallel, located at one end or the other of the plurality of hangers. The various embodiments and relationships are further described below in regard to the drawings.

DRAWINGS

FIG. 1 is perspective view of a valet rack embodying the combination of the present invention.

FIG. 2 is a partial cross sectional elevation view of the combination of FIG. 1 at 2—2.

FIG. 3 is a detail of a hanger element.

DETAILED DESCRIPTION OF THE INVENTION

Figure 6:
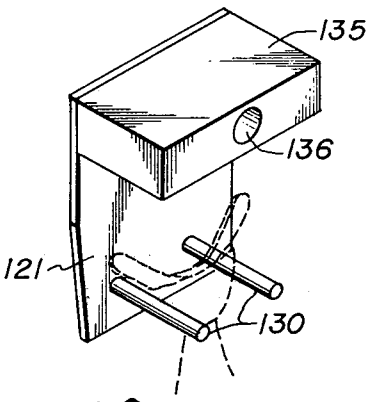
FIG. 6 is a detail of a hanger element of an alternate configuration.

In the following description of the invention in regard to the drawings, the same parts in different embodiments have been given the same indicia where possible and similar indicia have been used where this was not possible. Referring now to FIG. 1, the valet rack is shown in a perspective view. The valet rack is comprised of a back 11 and attached thereto a forward projecting shelf 12.

Above the shelf and affixed to the back is a mirror 10 and on either side of the mirror, racks 33 and 34. The racks 33 and 34 are intended to hold such items as fountain pens, pencils, combs, and the like. On either end of the valet rack attached to the back 10 and the shelf 12 and extending downward from said shelf are end members 13 and 14.

Immediately below the shelf 12 are a series of drawers 17 each of which is equipped with a handle 18. These drawers operate in an entirely conventional manner and are open for use merely by pulling the handle forward from the valet rack. The valet rack itself is intended to be attached to a wall or to a closet door or the like. Below the drawers and forming a ledge is plate 15 which is attached across the front the valet rack terminating on the end members 13 and 14, respectively. Below the drawers and embraced by the end members 13 and 14 are the hangers. Rods 16 located at either end represent one type of hanger, which are intended to hold belts, four-in-hand ties and the like. Of particular interest is the subcombination of movably mounted hangers, which comprise back plates 20, 21, 22, 23, 24 and 25 which are slidable mounted in the valet rack and fixedly mounted members 19 and 26.

Figure 4:
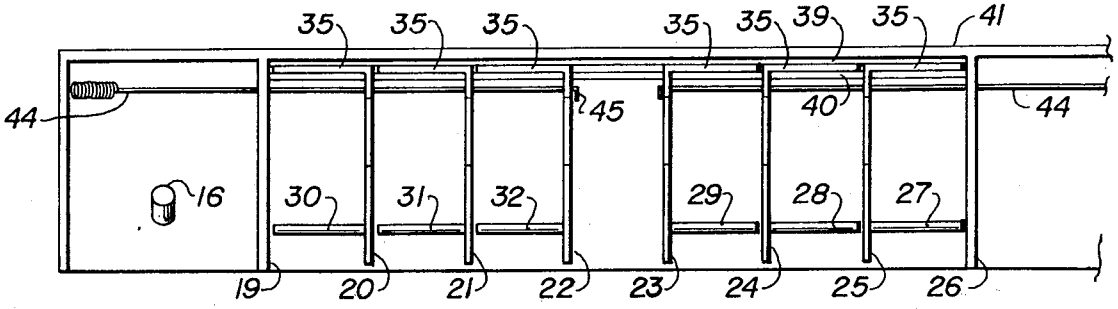
FIG. 4 is a partial front elevation of FIG. 1 showing one hanger subcombination.

This arrangement can be better seen in FIG. 4 to which reference is made. In FIG. 4, it can be seen that the slidably mounted hangers are divided into two groups of three each. This particular division has no significance other than the application to the combination in the valet rack. Slidable back plates 20, 21 and 22 are biased towards fixedly mounted wall 19 by means of a helical tension spring which passes through wall 19 and each of the slidable back plates 20, 21 and 22 and is held against back plate 22 by hook 45. Attached to each back plate 20, 21 and 22 are a pair of rods 30, 31 and 32, respectfully. These rods terminate adjacent to the surface of either wall 19 or the back plate of the next adjacent slidable hanger element.

Referring to FIG. 3 the hanger element which can be seen in detail, is comprised of the back plate 21 and attached atop thereof is a slide plate 35, which will be described below in relation to the remainder of the subcombination along with its manner of operation. Also in FIG. 3 an opening 36 is shown in the hanger element. This is the hole though which the spring 44 extends as was described above.

Referring back now to FIG. 4 back plates 23, 24 and 25, containing rod pairs 29, 28 and 27, respectfully attached thereto, are biased by a spring 44 toward fixed wall 26. The plate 15 has been removed in FIG. 4 exposing a portion of the slide system from the front elevation. Slide plates 35 are shown to be seated in a channel form by elements 39 and 40 which extend across the front of the valet rack.

Figure 5:
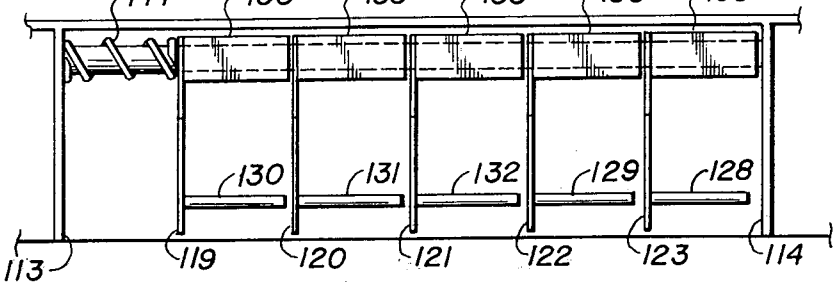
FIG. 5 is a front elevation of another hanger subcombination.

The shelf 41 extends across the length of the valet rack and provides the basis for the drawers therein. The relationship of the various elements of the valet rack combination may be best seen in FIG. 2 which is a cross section taken at 2—2 of FIG. 1. In that figure it can be seen that the slide plate 35 is seated between two elements 37 and 38 which are attached to the back 11 of the valet hanger. The drawer is shown seated in the closed position in the valet hanger resting on shelf 41 and closed on the top thereof by shelf 12. A second subcombination is shown in this figure also. In this subcombination the drawer 17 is held firmly in place by a magnet 43 fixedly attached to back 11 and aligned so as to contact either a magnet of the opposite polarity which is fixedly attached to the back of drawer 17 or a metal plate at the back of drawer 17, which of course could be itself the back of the drawer. This latching arrangement makes the valet rack quite suitable for hanging on a door, since when the door is closed or opened the drawer does not have the tendency to move, as would an ordinary drawer. hanger of the present invention is shown in FIG. 5. In that figure the back plates are represent as 119, 120, 121, 122 and 123 with pairs of rods 130, 131, 132, 129, and 128 attached thereto respectfully. Each back plate is attached to slide member 135, which is mounted onto a rod 137 which extends between the two end members 113 and 114. A helical compression spring 144 is biased against hanger element 119 thereby forcing all of the hanger elements in one direction.

In FIG. 6 the hanger element from the altermate embodiment is more clearly shown. Also a pre-tied tie is shown by the dotted lines situated between the substantially parallel rods 130 extending from the hanger.

The hanger subcombination of the present invention can of course be applied to other types of uses, for instance, it could be used to hang fan belts or rings or if only one rod were employed it could be used to hang prepackage items frequently found in stores, such as washers, nut bolts, and the like.

To operate the embodiment of FIG. 5 in order to gain access to the rods on which to hang something one merely pushes the hanger element in the direction of the biasing element (arrow) i.e., the spring. In the configuration shown in FIG. 4 the hanger element is pressed in the direction away from the spring, thus allowing a sufficient space to reach in and place an item onto the rods projecting from the hanger element or to remove an item that is hung there. The advantage of this arrangement is that the hangers are placed in a fixed location when not in active use. This is particulary useful in keeping items which are hung thereon, from falling off or being knocked off. The aspect of springs is an important feature of the present invention for the reasons setforth above and also for the sake of appearance.

The valet rack combination may be made out of any number of materials. It makes an attractive decorative item, particularly if made out of a finished wood or an appropriate selection of plastic materials.

I claim:

1. A drawer latching device comprising a body having openings therein, drawers movably located in said openings and having a first metal plate member fixedly attached at the back thereof in operable alignment with a metal plate member immobily affixed to said body in contacting alignment with the first metal plate member on said drawer, said metal plate members contacting when said drawer is in the closed position in said body, at least one of said metal members being magnetized, thereby releasably maintaining the drawer in the closed position by magnetic attraction between said metal plate members.

* * * * *